United States Patent [19]

Temple et al.

[11] Patent Number: 4,618,506

[45] Date of Patent: Oct. 21, 1986

[54] METHOD OF PROVIDING A METAL MIRROR

[75] Inventors: James S. Temple; Petrus E. J. Legierse; Theodorus H. G. Martens, all of Eindhoven, Netherlands

[73] Assignee: U.S. Philips Corporation, New York, N.Y.

[21] Appl. No.: 587,793

[22] Filed: Mar. 9, 1984

[30] Foreign Application Priority Data

Dec. 27, 1983 [NL] Netherlands ..... 8304443

[51] Int. Cl.[4] ..... B05D 1/00; B05D 3/00; B05D 5/06

[52] U.S. Cl. ..... 427/40

[58] Field of Search ..... 427/40, 162, 164, 304, 427/322, 404, 443.1; 350/97

[56] References Cited

U.S. PATENT DOCUMENTS

| | | | |
|---|---|---|---|
| 3,788,895 | 1/1974 | Schimmer et al. | 427/96 |
| 3,895,124 | 7/1975 | Louch | 427/10 |
| 3,916,048 | 10/1975 | Walles | 428/463 |
| 4,290,075 | 9/1981 | Jacobs et al. | 428/913 |
| 4,309,713 | 1/1982 | Shinozaki et al. | 428/463 |
| 4,337,279 | 6/1982 | Polak | 427/40 |
| 4,420,506 | 12/1983 | Nelissen et al. | 427/162 |

FOREIGN PATENT DOCUMENTS 2070070 9/1981 United Kingdom .

*Primary Examiner*—Richard Bueker
*Attorney, Agent, or Firm*—Norman N. Spain

[57] ABSTRACT

A method of providing a metal mirror on polycarbonate in which the surface of polycarbonate is pretreated with an aminosilane, preceded by a corona discharge and/or succeeded by a treatment with tannin.

6 Claims, 1 Drawing Figure

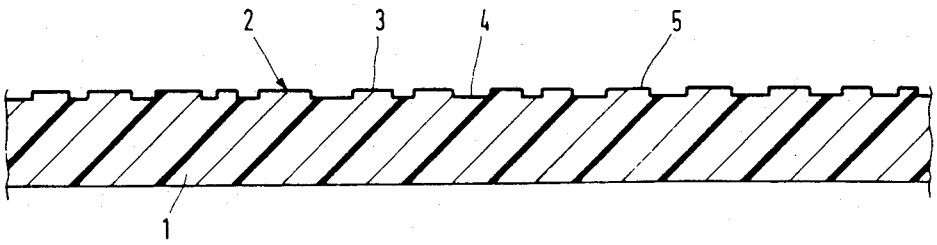
2
3
4
5
1

METHOD OF PROVIDING A METAL MIRROR

The invention relates to a method of providing a metal mirror on a surface of a polycarbonate synthetic resin.

It has so far not proved possible to provide a readily adhering metal layer, for example in particular a silver mirror, on a surface of polycarbonate.

From published British Patent Application No. 2,070,070 a method is known of providing a metal mirror on synthetic resin substrates, for example, a substrate of polycarbonate. It is stated in the examples 2, 3 and 4 of the British Patent Application that a surface of polycarbonate is first provided with a layer of a polymer on a silicate basis or of a silicon resin (the so-called base coat). An adhesive, the so-called primer, is provided thereon by dipping the surface in a solution of three silane compounds in a mixture of organic solvents. Finally a silver layer is provided by means of a vapour deposition process in a vacuum.

The adhesion is tested by means of the diamond scratching test described on page 6, lines 25–30 of the British Patent Application. The results show that 65% of the silver layer had readily adhered to the surface.

The disadvantage of the known method is that no optimally adhering silver layer is obtained. Eventually, in the diamond scratching test the silver layer is removed in 35% of the areas due to insufficient adhesion. A further disadvantage is that by using the base coat a refined structure present in the surface of polycarbonate is masked.

It is an object of the invention to provide a method which does not exhibit the above-mentioned disadvantages. An additional object is to provide a method in which a metal mirror is obtained which adheres excellently to a surface of polycarbonate and which good adhesion is maintained when the surface provided with a metal mirror is subjected to an ageing process according to the climate test to be described hereinafter.

An additional object is to provide a method in which the structure of the surface of polycarbonate is maintained after metallization.

Still another object as to provide a method in which a known electroless chemical metallization process, hence metallization from a solution, may be used.

These and further objects are achieved by means of the method according to the invention which is characterized in that the surface is treated with an aminosilane, that the treatment with aminosilane is preceded by a corona discharge applied to the surface and/or is succeeded by a treatment of the surface with tannin, and that finally a metal mirror is provided according to a known electroless chemical metallization process.

The method according to the invention comprises the following possibilities or pretreatment. Pretreatment is to be understood to mean herein the treatment of the surface of polycarbonate before the metal mirror is provided.

1. corona discharge succeeded by treatment with aminosilane
2. treatment with aminosilane and then with tannin
3. corona discharge, treatment with aminosilane and then with tannin.

The extra corona discharge according to possibility 3 as compared with possibility 2 causes the subsequent treatment with silane to be facilitated. For example, a lower concentration of the aminosilane or a shorter treatment time will suffice.

In the method according to the invention a known electroless chemical metallization process is used. According to this process, the surface to be metallized is sensitized with, for example, an acid $SnCl_2$ solution. The sensitized surface is treated with successively or simultaneously an aqueous metal salt solution and an acqueous solution of a reduction agent. The metal salt is reduced and a metal mirror is formed. The sensitizing agent promotes the deposition of the metal atoms. Upon silver-plating, an ammoniacal aqueous solution of a silver salt, for example silver nitrate, is used. The reduction agent is, for example, formaldehyde, optionally in combination with a sugar, for example sodium glyconate. Examples of other useful reduction agents are hydrazine sulfate, hydroxyethyl hydrazine and glyoxal. An interesting method is known from Technical Proceedings of the 51st Annual Convention of the American Electroplaters' Society, 14–18 June, St. Louis, 1964, pp. 139–149. According to this method the metal salt solution and the solution of the reduction agent are simultaneously atomized on the surface to be metallized.

In the method according to the invention the aminosilane is preferably used in the form of an aqueous solution. The hydrolyzable groups present in the aminosilane, for example notably alkoxy groups, are hydrolized in water, in which hence —OH groups are formed. The hydrolized aminosilane does not condense in an aqueous medium. The aqueous solution may comprise, if desired, a comparatively small quantity of an organic solvent, for example 10% by volume.

The surface of polycarbonate can be dipped in the aqueous solution of the aminosilane. The solution may also be atomized, sprayed, poured etc. on the surface. The concentration of the aminosilane in the solution is not restricted to narrow limits and is, for example, from 0.01 to 10 g per 100 ml of water. A suitable concentration is from 0.01 to 1 g per 100 ml of water.

The aminosilane reacts with the surface of polycarbonate. Chemical bonds are formed. In applicants' opinion chain fracture takes place in the polycarbonate as a result of the reaction of the $—NH_2$ group of the aminosilane with the carbonyl group of the polycarbonate in which a urethane structure is formed.

The chemically bound silane forms an extremely thin layer having a thickness with corresponds to a few layers of molecules on the surface of polycarbonate.

In a favourable embodiment of the method according to the invention an aminosilane is used which satisfies the general formula I

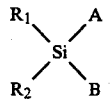

(I)

wherein

A is an organofunctional group which comprises an $—NH_2$ group,

B is an organofunctional group which comprises an $—NH_2$ group or an alkoxy group having 1–4 C-atoms, $R_1$ and $R_2$ represent an organofunctional group.

Good results are obtained in particular with an aminosilane which satisfies the formula II

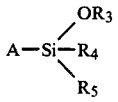

(II)

wherein

A has the above meaning, $R_3$ is an alkyl group having 1–4 C-atoms $R_4$ and $R_5$ are equal or different and represent an alkyl group or an alkoxy group having 1–4 C-atoms.

An aminosilane according to formula I or II is preferably used wherein A is an organofunctional group which satisfies the formula $$[(CH_2)_m-(NH)_n-(CH_2)_p]_qNH_2$$

wherein m=1–4 n=0 or 1 p=1–4 q=1–3.

A very suitable aminosilane is 3-aminopropyl triethoxy silane.

Examples of other well useful aminosilanes are: aminoethyl-3-aminopropyltriethoxysilane according to the formula

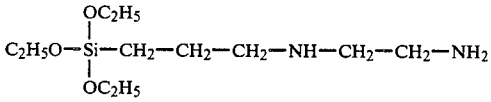

aminoethyl-2-aminoethyltrimetoxysilane of the formula

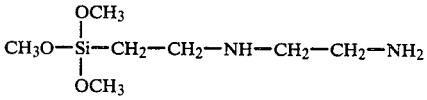

trimethoxysilylpropyldiethylenetriamine of the formula

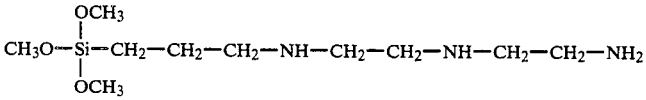

and triethoxysilylpropyldiethylenetriamine of the formula

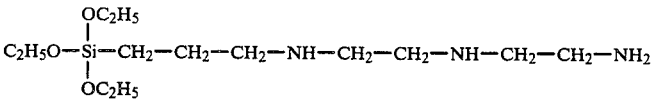

The treatment with tannin is carried out by dipping the surface of polycarbonate in an aqueous solution of tannin. Alternatively, an aqueous solution of tannin may be sprayed, atomized, poured etc. on the surface of polycarbonate. The solution may, if desired, comprise water miscible organic solvents, for example an alcohol, ketone, ether or ester. The concentration of tannin may be chosen between wide limits and is, by way of example, from 0.1 to 10 g of tannin per liter.

A corona discharge is a process in which a high voltage (for example alternating voltage) is applied between the synthetic resin surface of polycarbonate and an electrode. As a result of the electric discharge, high-energy particals will be formed, for example, atomic oxygen, electrons, ions and the like, which impact against the surface as a result of which the composition of the polycarbonate at the surface varies. Oxygen may be bound to the surface. As a result of this the surface obtains a more hydrophilic character.

The invention may advantageously be used in the metallization of an optical component and in particular of an optically readable information carrier which comprises a substrate of polycarbonate which has an optically readable information track on one or on both surfaces. The track has a crenellated profile of information areas situated alternatively at a higher level at a lower level. The difference in height is from 0.1–0.2 μm. The longitudinal dimensions of the areas are preferably between 0.3 and 3 μm. By using the method according to the invention, a readily adhering metal mirror, for example a silver mirror, is provided on the surface of the substrate comprising the information track, the optical structure being maintained. Such an information carrier forms part of the present invention.

The invention will be described in greater detail with reference to the following example and the drawing the sole FIGURE of which is a tangential sectional view of an optical information carrier.

EXAMPLE

An optically readable information carrier shown in the figure comprises a substrate 1 of polycarbonate having a thickness of 1 mm. The diameter of the carrier is 12 cm. Substrate 1 comprises on one side an information track 2 which is provided by means of an injection moulding process or compression moulding process and which is spirallike or is constructed from concentric circles. The information track 2 comprises audio or video information. The information track 2 which can be read optically by means of laser light has a crenellated profile of information areas situated alternately at a higher level 3 and at a lower level 4.

The substrate 1 of polycarbonate is dipped for 15 seconds in a solution of 1 g of 3-aminopropyltriethoxysilane in 100 ml of water. The substrate is then rinsed with water and then dipped for two minutes in an aqueous solution of tannin (=tannic acid) comprising 0.4 g of tannin per 100 ml of water. After the treatment with tannin, a metal mirror, for example a silver mirror, is provided by electroless deposition. For this purpose, the surface of polycarbonate is treated with a sensitizing solution. In the case of providing a silver layer the surface is treated for 1–60 seconds with a sensitizing solution comprising an acid $SnCl_2$-solution. The concentration of $SnCl_2$ is not restricted to narrow limits and is, for example, from 0.01 to 1 g of $SnCl_2$ per liter and preferably is approximately 0.1 g per liter. The treatment may be carried out by means of, for example, a dipping process, a pouring process or a spraying process. The surface of polycarbonate is then treated with the actual metallization solutions, so with the aqueous metal salt solution, for example, an ammoniacal silver nitrate solution and an aqueous reduction agent solution. A suitable reduction agent is, for example, formaldehyde, in combination with a sugar, for example sodium gluconate. The metallization solutions are preferably provided according to the aerosol metallization process in which the solutions are simulataneously atomized on the surface. This process, as well as the metal salt solutions and reduction agent solutions used therein, are described, for example, in the above-mentioned literature reference "Technical Proceedings". Various metallization chemicals are commercially available from, for example, Messrs. Ermax, London Laboraties Ltd. or Merck.

The adhesion of the silver layer 5 thus provided electrolessly (see figure) on the surface of polycarbonate is tested according to the so-called diamond scratching test (DIN 53151). According to this standard test twelve scratches are provided in the surface of the metal layer so as to extend over the whole thickness of the metal layer. The pattern of scratches comprises six parallel scratches having a mutual distance of 1 mm which are crossed at right angles by likewise 6 parallel scratches having a mutual distance of 1 mm so that the pattern of scratches comprises 25 areas of 1 $mm^2$. An adhesive tape is pressed on the pattern of scratches and is then pulled off from the surface. The extent of adhesion is expressed in numbers 0–5, in which:

0=optimal adhesion; 0 areas work loose
1=good adhesion; 1–5 areas work loose
2=reasonable adhesion; 6–10 areas work loose
3=insufficient adhesion; 11–15 areas work loose
4=poor adhesion; 16–20 areas work loose
5=no adhesion; 21–25 areas work loose.

In a second test series, substrates of polycarbonate which are pretreated and silver-plated in the above manner are subjected to a climate test, sometimes termed cyclic moisture test.

According to this test the substrates are stored at periodically varying climatological conditions for a test period of three weeks. For this purpose the substrates are placed in a climate box and are subjected per 24 hours to a temperature and moisture cycle, the substrates being kept at a temperature of 45° C. for 8 hours at a relative humidity of 70–90%, and a temperature of 25° C. for a period of 16 hours at a relative humidity of 100%.

The adhesion of the silver layer is determined according to the above-described diamond scratching test.

THe results are recorded in the table. If in the pretreatment, for example the treatment with the aminosilane, a longer reaction time is chosen, preferably between 15 seconds and 1 hour, for example, a few minutes, and/or a lower concentration of preferably 0.1 g of the aminosilane in 100 ml of water, the same good results are obtained.

In another series of tests the substrate of polycarbonate is subjected to a corona discharge on the side of the information track. For this purpose, a HF-generator having a sinusoidal alternating voltage of 12–18 kV and a frequency of 20–40 kHz is connected to an electrode placed above the surface of polycarbonate. The reaction time is a few seconds.

The surface of polycarbonate is then treated in the above-described manner with an aqueous solution of an aminosilane, a sensitizing agent and metallization solutions in which a silver mirror is formed.

The adhesion of the silver mirror to the surface of polycarbonate is determined by means of the diamond scratching test. This test is applied both to substrates which are not subjected to the climate test and to substrates which have been subjected for three weeks to the cyclic moisture test described hereinbefore.

The results are recorded in the table.

In still another series of tests, substrates of polycarbonate are subjected to a corona discharge on the side of the information track, are then treated with an aqueous solution of an aminosilane, an aqueous solution of tannin, a sensitizing agent and metallization solutions for providing an silver mirror. The various treatments have been described hereinbefore. The adhesion of the Ag mirror is determined by means of the diamond scratching test. The adhesion is measured both prior to and after the cyclic moisture test.

The results are recorded in the table.

As a comparative test the surface of polycarbonate was pretreated with only tannin. An silver mirror is then provided on the treated surface according to the above-described electroless chemical metallization process, so by a treatment with a sensitizing agent ($SnCl_2$) and metallization solutions. The results of the adhesion test, prior to and after the cyclic moisture test, are recorded in the table.

TABLE

Results adhesion test.

| Pretreatment | Adhesion: prior to cyclic moisture test | Adhesion: after cyclic moisture test |
|---|---|---|
| aminosilane and tannin | 0 | 0 |
| corona and aminosilane | 0 | 0 |
| corona, aminosilane and tannin | 0 | 0 |
| tannin | 3–4 | 5 |

What is claimed is:

1. A method of providing an adhering metal layer on a surface of polycarbonate, characterized in that the surface is treated with an aminosilane, that the treatment with aminosilane is preceded by a corona discharge applied to the surface and/or is succeeded by a treatment of the surface with tannin, and that finally a metal mirror is provided according to a known electroless chemical metallization process.

2. A method as claimed in claim 1, characterized in that an aminosilane is used which satisfies the general formula I

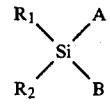

(I)

wherein

A is an organofunctional group which comprises an —$NH_2$-group

B is an organofunctional group which comprises an —$NH_2$-group or an alkoxy group having 1–4 C-atoms $R_1$ and $R_2$ represent an organofunctional group.

3. A method as claimed in claim 2, characterized in that an aminosilane is used which satisfies the formula II

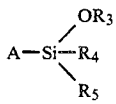

(II)

wherein

A has the above meaning $R_3$ represents an alkyl group having 1–4 C-atoms $R_4$ and $R_5$ are equal or different and represent an alkyl group or an alkoxy group having 1–4 C-atoms.

4. A method as claimed in claim 2, characterized in that an aminosilane according to formula I is used, wherein A is an organofunctional group which satisfies the formula $$[(CH_2)_m-(NH)_n-(CH_2)_p]_qNH_2$$

wherein m=1–4 n=0 or 1 p=1–4 q=1–3.

5. A method as claimed in claim 4, characterized in that, 3-aminopropyltriethoxysilane is used.

6. A method as claimed in claim 3, characterized in that an aminosilane according to formula II is used, wherein A is an organofunctional group which satisfies the formula $$[(CH_2)_m-(NH)_n-(CH_2)_p]_qNH_2$$

wherein m=1–4 n=0 or 1 p=1–4 q=1–3.

* * * * *